US011558944B2

(12) United States Patent
Liu

(10) Patent No.: US 11,558,944 B2
(45) Date of Patent: Jan. 17, 2023

(54) METHOD OF PRODUCING LIGHT ANIMATION WITH RHYTHM OF MUSIC

(71) Applicant: AMERICAN FUTURE TECHNOLOGY, City of Industry, CA (US)

(72) Inventor: You-Chi Liu, City of Industry, CA (US)

(73) Assignee: AMERICAN FUTURE TECHNOLOGY, City of Industry, CA (US)

( * ) Notice: Subject to any disclaimer, the term of this patent is extended or adjusted under 35 U.S.C. 154(b) by 246 days.

(21) Appl. No.: 17/098,853

(22) Filed: Nov. 16, 2020

(65) Prior Publication Data

US 2022/0159810 A1 May 19, 2022

(51) Int. Cl.
*H05B 47/105* (2020.01)
*G10L 25/18* (2013.01)
*G10L 25/51* (2013.01)

(52) U.S. Cl.
CPC ..... *H05B 47/105* (2020.01); *G10L 25/18* (2013.01); *G10L 25/51* (2013.01); *G10H 2210/036* (2013.01); *G10H 2210/071* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,570,078 | B2 * | 5/2003 | Ludwig | G06F 3/04847 84/478 |
| 10,335,572 | B1 * | 7/2019 | Kumar | A61H 9/0078 |
| 10,492,981 | B1 * | 12/2019 | Kumar | A61H 19/44 |
| 10,685,488 | B1 * | 6/2020 | Kumar | A61H 23/04 |
| 2002/0047646 | A1 * | 4/2002 | Lys | F21S 4/28 315/312 |
| 2021/0023332 | A1 * | 1/2021 | Auger | A61B 5/165 |

* cited by examiner

*Primary Examiner* — Monica C King
(74) *Attorney, Agent, or Firm* — Muncy, Geissler, Olds & Lowe, P.C.

(57) ABSTRACT

A method of producing a light animation with a rhythm of music is disclosed. An electronic device performs Fourier series transform on a sound signal of music produced from at least one musical instrument, so as to obtain a rhythm diagram of the sound signal. The operation to extract a rhythm change point of the rhythm diagram is performed, and when the intensity of the rhythm diagram has a change from increase to decrease, the time point of the change is used as the rhythm change point and the electronic device transmits a lighting control signal to a light emitting device. After receiving the lighting control signal, the light emitting device emits light based on the lighting control signal, and the light emitted from the light emitting device continues to form the light animation, thereby improving overall performance appreciation of the music for audiences.

4 Claims, 3 Drawing Sheets

METHOD OF PRODUCING LIGHT ANIMATION WITH RHYTHM OF MUSIC

BACKGROUND OF THE INVENTION

1. Field of the Invention

The present invention relates to a method of producing light animation with rhythm of music. More particularly, the method of the present invention performs Fourier series transform on a sound signal of music, to obtain a rhythm diagram, and then extracts a rhythm change point of the rhythm diagram, so that the light emitting device can produce the light animation when the intensity of the rhythm diagram has a change from increase to decrease, thereby making the audience feel the light animation with the rhythm of the music.

2. Description of the Related Art

With the rapid development of technology, simple auditory enjoyment is more and more difficult to satisfy people's sensory requirement, so many music devices are designed to provide audiences more visual experience and add more atmospheres to the audiences in the process of listening to music. For example, most of the conventional music-and-lighting interactive devices can control the lighting effects through the system preset by the lighting manufacturers, and the program for adjusting light color and brightness according to the style and rhythm of the played music is pre-installed in the music-and-light interaction device, and the program can be executed to produce light animation during the performance of the music.

However, the above-mentioned pre-setting method usually fails to provide the best combinational effects of music and lighting, and may cause the poor sensory experience and reduce the live music atmosphere. Moreover, creation of the lighting interaction effects for many pieces of music has high time and effort cost, so the lighting manufacturer does not create the lighting interaction effect for every piece of music. Moreover, the lighting manufacturer usually adjusts the light color and brightness based on the change points of magnitude and frequency of sound, but these two methods may disorder the lighting interaction effect to make the audience uncomfortable. Furthermore, people feel the variation of music mainly based on the rhythm in the music, and the rhythm is combination of the timing, sequence, intensity and weakness of music, and the music fails to proceed in an orderly manner without rhythm.

Therefore, how to automatically extract the rhythm of the music and produce lighting effects in accordance with the rhythm is a key issue in this industry.

SUMMARY OF THE INVENTION

In order to solve the conventional problems, the inventors develop the method of producing light animation with rhythm of music according to the collected data, multiple evaluations and tests, and years of experience in the industry.

An objective of the present invention is that the electronic device performs Fourier series transform on a sound signal, which is produced from at least one musical instrument, of the music, to obtain a rhythm diagram of the sound signal, and the electronic device then performs an operation to extract a rhythm change point of the rhythm diagram; when the intensity of the rhythm diagram has a change from increase to decrease, a time point of the change is used as the rhythm change point and the electronic device transmits a lighting control signal to the light emitting device. After receiving the lighting control signal, the light emitting device emits light based on the lighting control signal, and the light emitted from the light emitting device can continue to form the light animation, so that the light emitting device can produce the light animation according to the rhythm of the played music, for the audience to listen music and see the light animation with the rhythm of music, thereby achieving the purpose of improving overall performance appreciation and coordination of the music.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
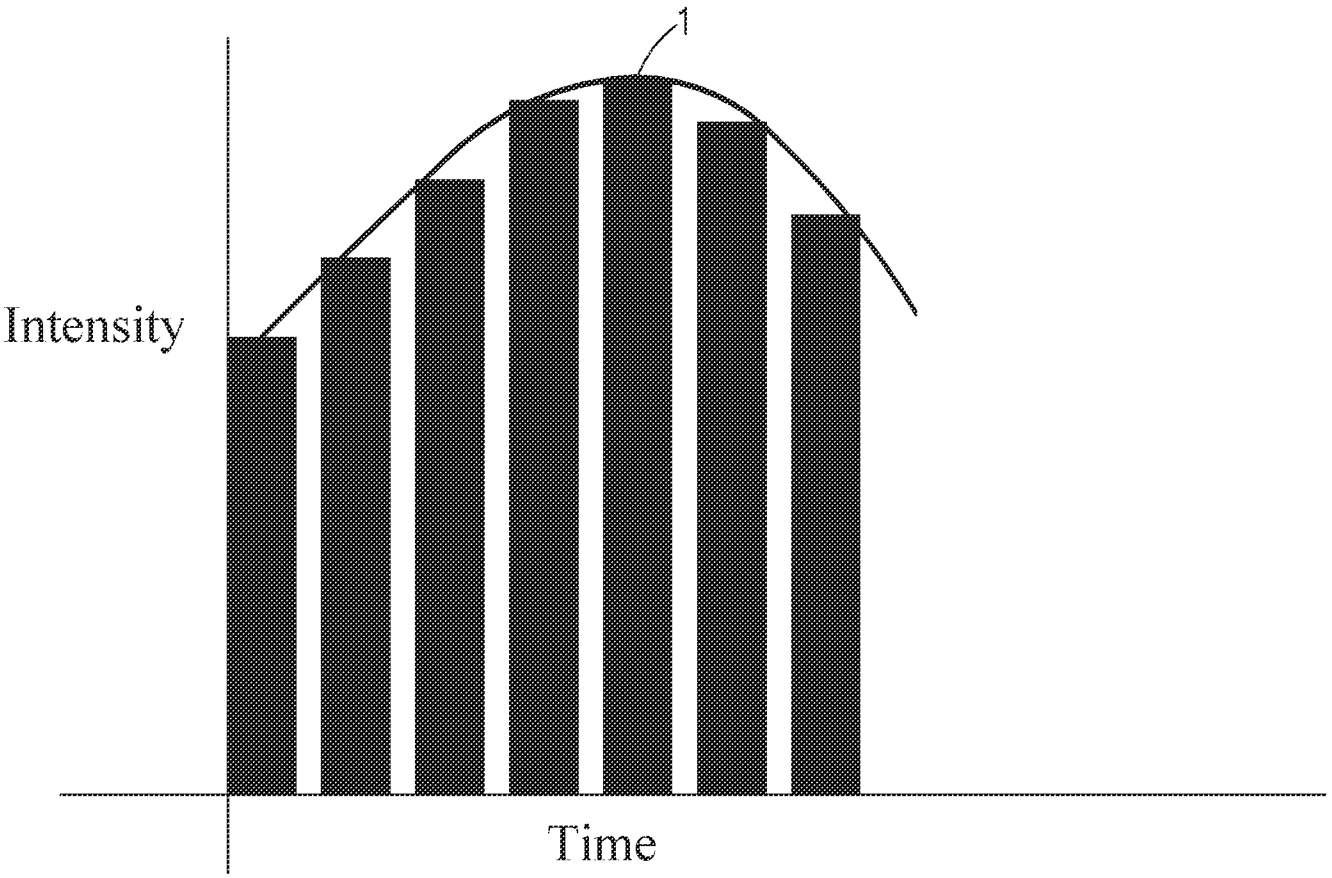
FIG. 1 shows a rhythm diagram of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. As used herein, the term "or" includes any and all combinations of one or more of the associated listed items.

In addition, unless explicitly described to the contrary, the word "comprise" and variations such as "comprises" or "comprising", will be acknowledged to imply the inclusion of stated elements but not the exclusion of any other elements.

Figure 2:
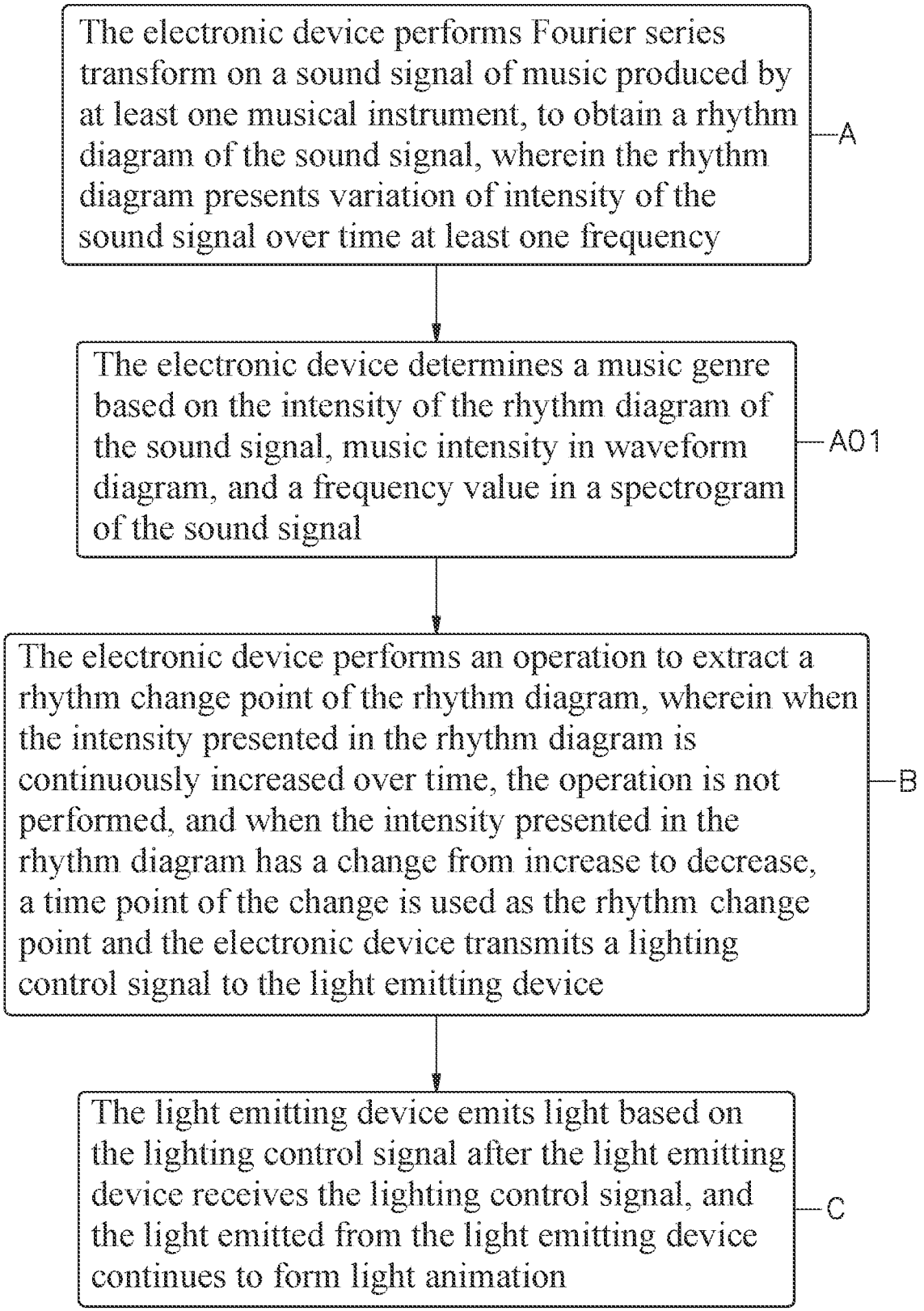
FIG. 2 is a flowchart of a method of producing light animation with rhythm of music, according to the present invention.
Figure 3:
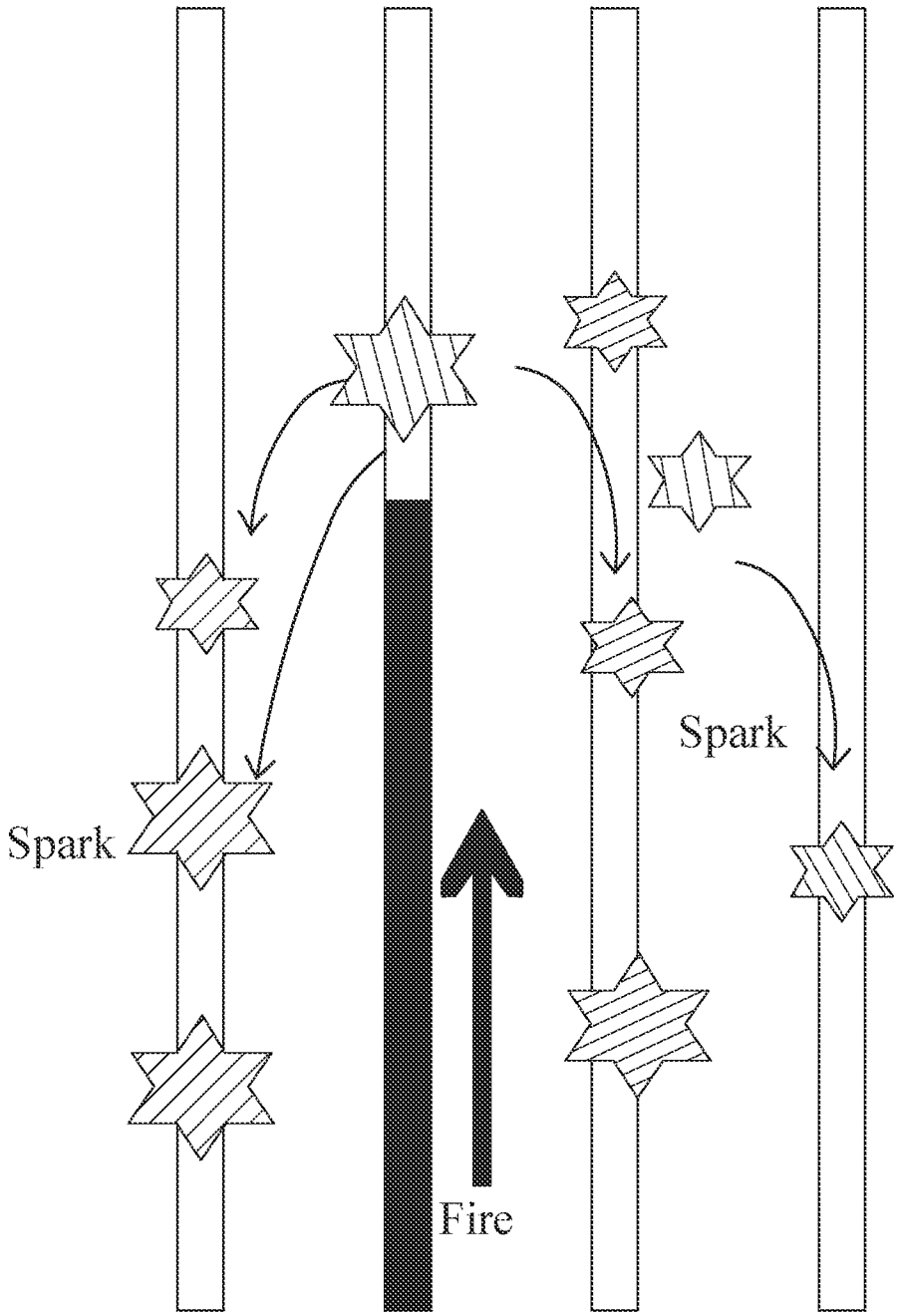
FIG. 3 is a schematic view of a played light animation, according to the present invention.

Please refer to FIGS. 1 to 3, which are a rhythm diagram, a flowchart of a method of producing light animation with rhythm of music, and a schematic view of the played light animation, according to the present invention. As shown in FIGS. 1 to 3, the method of the present invention includes following steps.

In a step (A), an electronic device performs Fourier series transform on a sound signal, which is produced by at least one musical instrument, of the music, so as to obtain a rhythm diagram of the sound signal. In an embodiment, the musical instrument can be, for example but not limited, a guitar, a drum, a bass, a piano or other musical instrument. The rhythm diagram presents the variation of intensity of the sound signal at at least one frequency over time.

In a step (B), the electronic device performs an operation to extract the rhythm change point 1 on the rhythm diagram; when the intensity presented in the rhythm diagram is continuously increased over time, the operation is not performed, and when the intensity presented in the rhythm diagram has a change from increase to decrease, the time point of the change is used as the rhythm change point 1 and the electronic device transmits a lighting control signal to the light emitting device.

In a step (C), after receiving the lighting control signal, the light emitting device emits light based on the lighting control signal, and the light emitted from the light emitting device can continue to form the light animation, so as to complete the using process of the present invention.

Preferably, the above electronic device can be a desktop computer, a notebook computer, a tablet computer, a smartphone, a personal digital assistant, or other electronic device with computing functions.

Furthermore, in an embodiment, the method of the present invention can include a step (A01) executed before the step (B). In the step (A01), the electronic device determines a music genre, such as jazz, rock, Latin, country, blues, R&B, hip-hop or other music genre, based on the intensity of the rhythm diagram of the sound signal, music intensity in a waveform diagram of the sound signal, and a frequency value in a spectrogram of the sound signal.

Preferably, the electronic device used in the step (B) can transmit an operation signal to an operation device through a transmission line; however, in actual applications, the operation signal can also be transmitted to the operation device by a wireless transmission manner, such as WI-FI, Bluetooth or infrared.

The light emitting device (such as LED) used in the above step (B) performs lighting variation with the rhythm of the music, so as to present the light animation with the light emitted from the light emitting device. The lighting variation can be, for example but not limited, water-dance variation simulation, torch variation simulation or any scene lighting effect variation.

Furthermore, in an embodiment, the light emitting device used in the step (C) can store light animations corresponding to various kinds of music genres in advance, so that the light emitting device can quickly produce the light animation when receiving the lighting control signal.

In practical use, the electronic device of the present invention first performs Fourier series transform on the sound signal produced by at least one musical instrument, to obtain the rhythm diagram of the sound signal, and then the electronic device extracts the rhythm change point 1 of the rhythm diagram, and during the process of extraction, when the intensity presented in the rhythm diagram continues to increase over time, the above-mentioned extracting operation is not performed, and when the intensity has a change from increase to decrease, a time point of the change is used as the rhythm change point 1, as shown at the peak of the waveform; at this time, the electronic device transmits the lighting control signal to the light emitting device, and after receiving the lighting control signal, the light emitting device emits light based on the lighting control signal, and the light emitted from the light emitting device continues to form the light animation, so that the light emitting device can produce the light animation based on the rhythm of the played music, for audience to see the light animation with the rhythm while listening the music, thereby achieving the purpose of improving overall performance appreciation and coordination of the music.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A method of producing light animation with rhythm of music, comprising steps:

(A), performing, by an electronic device, Fourier series transform on a sound signal, produced from at least one musical instrument, of the music, to obtain a rhythm diagram of the sound signal, wherein the rhythm diagram presents variation of intensity of the sound signal over time at least one frequency;

(B), performing, by the electronic device, an operation to extract a rhythm change point of the rhythm diagram, wherein when the intensity presented in the rhythm diagram is continuously increased over time, the operation is not performed, and when the intensity presented in the rhythm diagram has a change from increase to decrease, a time point of the change is used as the rhythm change point and the electronic device transmits a lighting control signal to the light emitting device; and (C), emitting light, by the light emitting device based on the lighting control signal after the light emitting device receives the lighting control signal, wherein the light emitted from the light emitting device continues to form light animation.

2. The method according to claim 1, wherein the electronic device is a desktop computer, a notebook computer, a tablet computer, a smartphone, or a personal digital assistant.

3. The method according to claim 1, further comprising a step (A01) before the step (B), (A01) determining, by the electronic device, a music genre based on the intensity of the rhythm diagram of the sound signal, music intensity in waveform diagram, and a frequency value in a spectrogram of the sound signal.

4. The method according to claim 1, wherein the light emitting device in the step (C) stores a plurality of light animations corresponding to a plurality of music genres.

* * * * *